US012304703B2

(12) United States Patent
Raymus

(10) Patent No.: US 12,304,703 B2
(45) Date of Patent: May 20, 2025

(54) CONTAINER LID WITH FLIP CAP AND NESTING CARRY LOOP

(71) Applicant: TRRS MAGNATE, LLC, Manteca, CA (US)

(72) Inventor: Thomas Anthony Raymus, Manteca, CA (US)

( * ) Notice: Subject to any disclaimer, the term of this patent is extended or adjusted under 35 U.S.C. 154(b) by 197 days.

(21) Appl. No.: 18/117,501

(22) Filed: Mar. 6, 2023

(65) Prior Publication Data

US 2024/0286804 A1 Aug. 29, 2024

Related U.S. Application Data

(63) Continuation-in-part of application No. 29/885,472, filed on Feb. 24, 2023, now Pat. No. Des. 1,003,107.

(51) Int. Cl.
*B65D 47/08* (2006.01)
*B65D 51/24* (2006.01)
*B65D 51/28* (2006.01)

(52) U.S. Cl.
CPC ..... *B65D 47/0876* (2013.01); *B65D 51/242* (2013.01)

(58) Field of Classification Search
CPC ..... B65D 47/0876; B65D 51/242; A45F 3/16
See application file for complete search history.

(56) References Cited

U.S. PATENT DOCUMENTS

D510,235 S 10/2005 Sorensen
D696,551 S 12/2013 Meyers et al.
D745,827 S 12/2015 Sorensen et al.
9,216,843 B2 12/2015 Sorensen et al.
D748,478 S 2/2016 Sorensen et al.
D752,382 S 3/2016 Ksiazek et al.
D752,390 S 3/2016 Ksiazek et al.
D758,127 S 6/2016 Zhao
D794,386 S 8/2017 Steel et al.
D820,038 S 6/2018 Sorensen et al.
D833,224 S 11/2018 Wahlkvist
D839,051 S 1/2019 Potter et al.
D854,880 S 7/2019 Meyers et al.
D878,149 S * 3/2020 Omdahl, II ..... D9/443
D878,150 S * 3/2020 Omdahl, II ..... D9/443
D881,648 S 4/2020 Xue
D897,149 S 9/2020 Sorensen et al.
D900,540 S 11/2020 Sorensen et al.
D904,108 S 12/2020 Gronkowski
D906,757 S * 1/2021 Omdahl, II ..... D7/396.2
D913,034 S 3/2021 Cornelius et al.
D920,041 S 5/2021 Chen et al.
D920,739 S 6/2021 Omdahl, II et al.
D926,521 S 8/2021 Gronkowski
(Continued)

*Primary Examiner* — Donnell A Long
(74) *Attorney, Agent, or Firm* — Boris Leschinsky

(57) ABSTRACT

A container lid, preferably for shaker bottles, with independently pivotable flip cap and carry loop that is configured to nest inside the flip cap. The lid body has integrally formed slots shaped and configured to retain narrow rounded portions of the interconnectable flip cap and carry loop. The underside of the lid may have one or more recesses that increase interior container volume, thus enhancing mixing functionality. The new structure provides space to accommodate a drinking user's nose and allows for 180-degree range of pivot for the flip cap and carry loop.

12 Claims, 8 Drawing Sheets

(56) References Cited

U.S. PATENT DOCUMENTS

| | | | | |
|---|---|---|---|---|
| 11,111,060 | B2 | 9/2021 | Sorensen et al. | |
| D946,345 | S | 3/2022 | Yao | |
| D965,387 | S | 10/2022 | Remele et al. | |
| 2014/0069918 | A1* | 3/2014 | Meyers | B65D 51/242 220/212.5 |
| 2017/0225850 | A1 | 8/2017 | Sorensen et al. | |
| 2019/0100362 | A1* | 4/2019 | Meyers | B65D 47/0885 |
| 2022/0097930 | A1 | 3/2022 | Sorensen et al. | |

* cited by examiner

CONTAINER LID WITH FLIP CAP AND NESTING CARRY LOOP

RELATED APPLICATIONS

This application is a continuation-in-part of U.S. design patent application Ser. No. 29/885,472, filed on Feb. 24, 2023, and claims priority thereto.

BACKGROUND

People of all walks of life use shaker bottles to mix, shake, and drink protein and other supplements. For many, it is a ritual to put their preferred supplements and liquids in a shaker bottle, shake vigorously, and drink, anticipating important health benefits. As more people become health aware and participate in exercise and sporting events, the use of shaker bottles continues to increase. Because shaker bottles are ubiquitous, it is easy to forget that their advent and popularity is relatively recent and that, therefore, design options and functionality somewhat limited. Significantly, the increased adoption of shaker bottles also spawns evolving consumer desire for variety, broadened functionality, and increased efficiency.

Existing shaker bottle designs have identifiable deficiencies. For example, many shaker bottles incorporate flip cap closures and carrying loops. The connections of these elements typically incorporate some form of hollowed out cylinder. This kind of design has several design disadvantages. For example, cylinders are susceptible to shrink and warp, giving an unstable, sticky, or uneven motion to the pivoting parts of the lid. Additionally, cylinders are bulky and use a lot of plastic material, thereby increasing the cost of manufacture and creating a drag on the environmental benefits for which reusable containers are normally touted. Also, conventional cylindrical connections raise the elevation of the lid resulting in an unwieldy obstacle to a drinking user's nose. The resulting dynamic restricts the container's angle of tilt and makes the drinking user tilt their head back awkwardly to drink. Furthermore, flip cap and carry loop combinations are restricted in their range of pivot, with one element restricting the range of motion of the other. Further disadvantages could be described.

What is needed is a new category of lid that addresses and overcomes the many disadvantages of current shaker bottle lids, including those that incorporate cylindrical flip cap and/or carry loop portions. Such a lid would provide advantages including stable pivoting connections, a large range of independent pivot for the flip cap and carry loop, and an accommodation for a drinking user's nose, among other improvements.

SUMMARY OF THE INVENTION

In accordance with the above, the invention includes a new container lid with flip cap and nesting carry loop that may be embodied within shaker bottle products. The lid has a lid body with drinking spout, a cap body with a closure for the drinking spout, and a carry loop with a connector that nests inside the cap body. The structure of these elements is unique and provides a number of functional advantages. For example, the lid body has integrally formed slots shaped and configured to retain narrow rounded portions of the independently pivotable cap body and carry loop. This provides improved stability and consistency of the pivoting elements while also using less material than other designs.

The underside of the lid may have one or more recesses that increase interior the interior volume within the lid (compared to other designs), thus enhancing mixing functionality. To explain, shaker bottles typically have dome-shaped or elevated lids designed to provide airspace within the lid and above the cup so that contents can move rapidly when shaken, especially when those contents were placed by a user close to the brim.

The lid may include a recess formed by the cap body and/or carry loop to accommodate a user's nose while drinking, thus increasing the angle of tilt and ease of use. The cap body and carry loop have an approximately 180-degree range of pivot.

BRIEF DESCRIPTION OF THE FIGURES

To further clarify the above and other aspects of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The drawings may not be drawn to scale. The invention will be described and explained with additional specificity and detail through the use of the accompanying drawings in which.

DETAILED DESCRIPTION OF THE ILLUSTRATED EMBODIMENT

Figure 1:
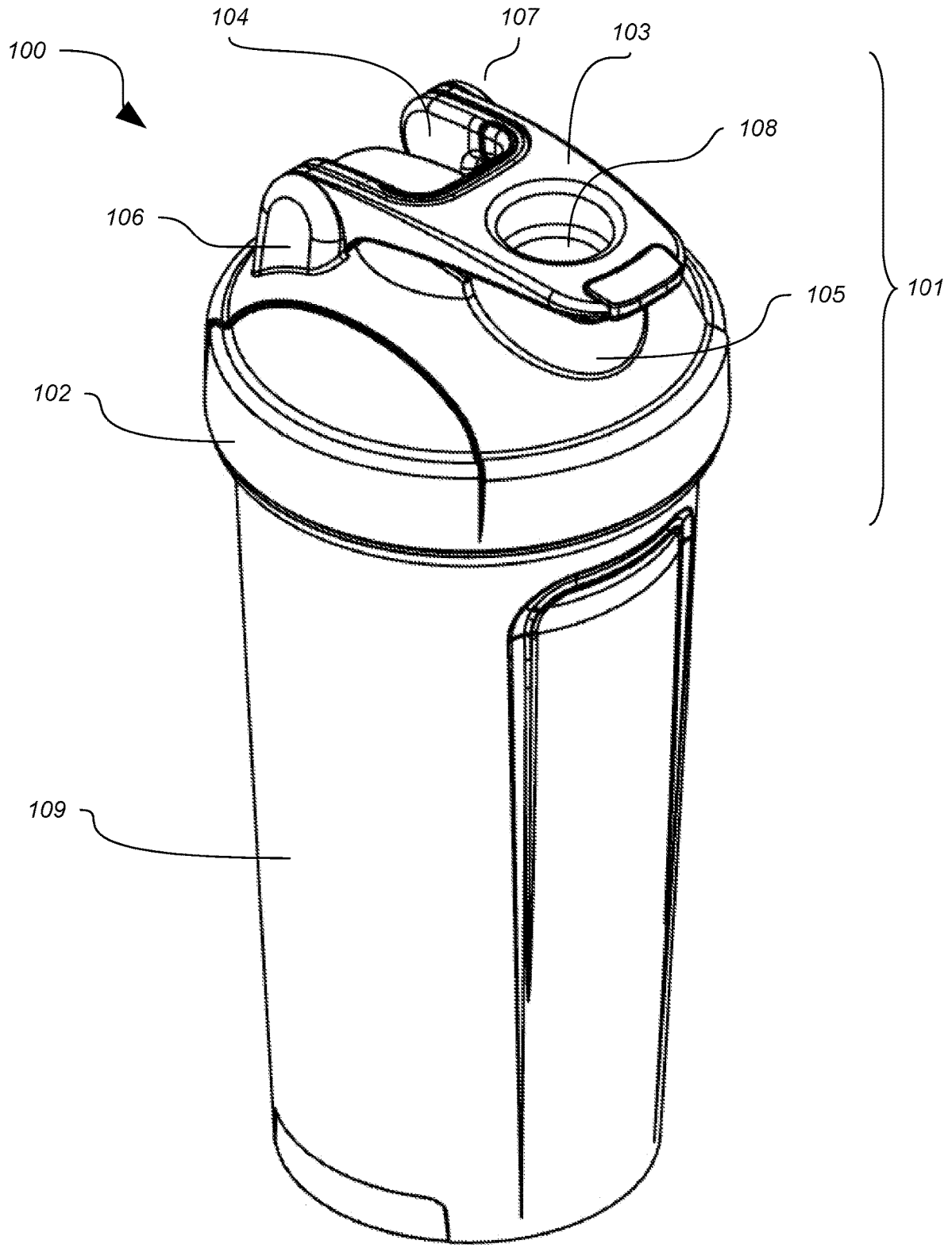
FIG. 1 is a first perspective view of one embodiment of a container lid in a shaker bottle environment.
Figure 2:
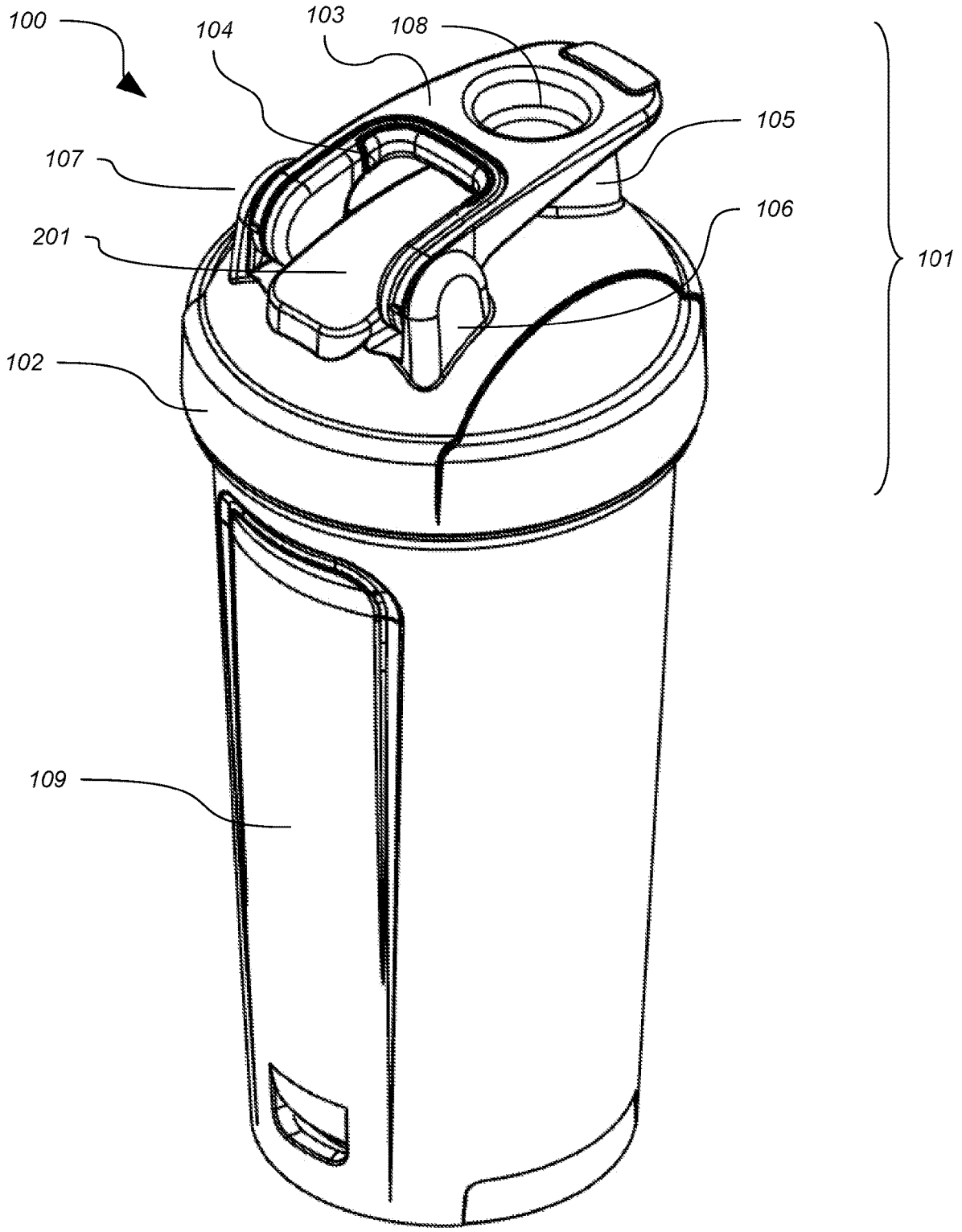
FIG. 2 is a second perspective view of a one embodiment of a container lid in a shaker bottle environment.

The present invention in its various embodiments, some of which are depicted in the figures herein, is a container lid with a flip cap and nesting carry loop 101. Referring now to FIGS. 1 through 4, a first, illustrated embodiment of the container lid 101 is shown in a shaker bottle environment 100. The container lid 101 includes: a lid body 102 with a drinking spout 105, a cap body 103 with a pivotable closure 108 for the drinking spout 105, and a pivotable ring (or carry loop) with a connector 104.

The lid body 102 has a first, integral projection 106 that extends from and above a top surface of the lid body 102 opposite and in-line with a second projection 107 that also extends from the top surface of the lid body 102. The projections 106, 107 may alternatively be referred to herein as "ears". Projections 106, 107 may have fastener portions (e.g., 301) configured to facilitate pivotable attachment of the cap body 103 and/or the carry loop 104 to the lid body 102. Across embodiments, such fastener portions may be, for example, recesses, partial apertures, pegs or connectors, or full apertures that extend through the ears. In the illustrated embodiment, the lid body 102 is generally domed with one or more ledge portions 201 generally located behind or aft of the drinking spout 105. However, other lid bodies in other embodiments may have different shapes and/or configurations without departing from the purposes or scope of the invention. The illustrated embodiment is shown for exemplary purposes only.

Figure 3:
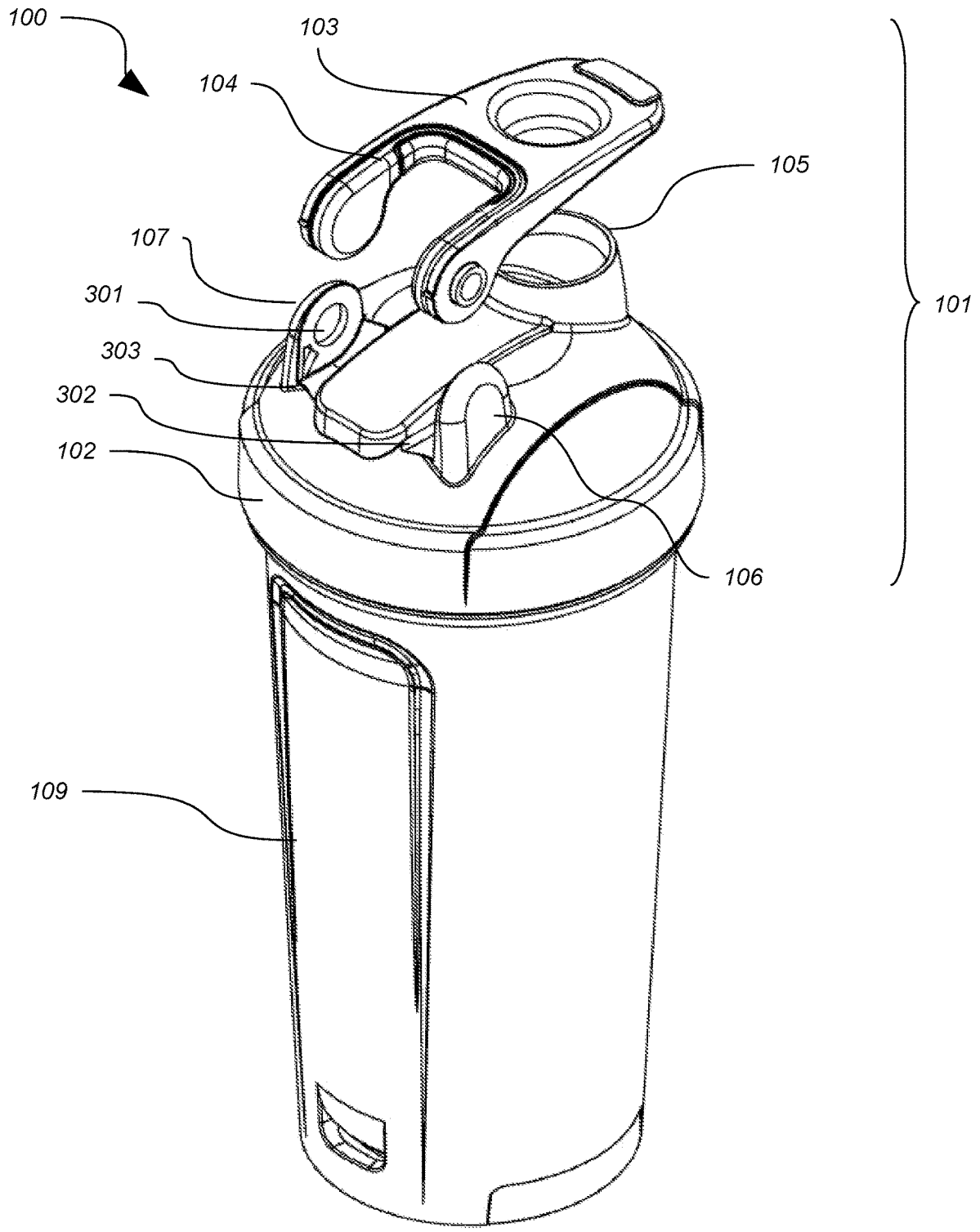
FIG. 3 is a third perspective, partially exploded view of one embodiment of a container lid in a shaker bottle environment.
Figure 4:
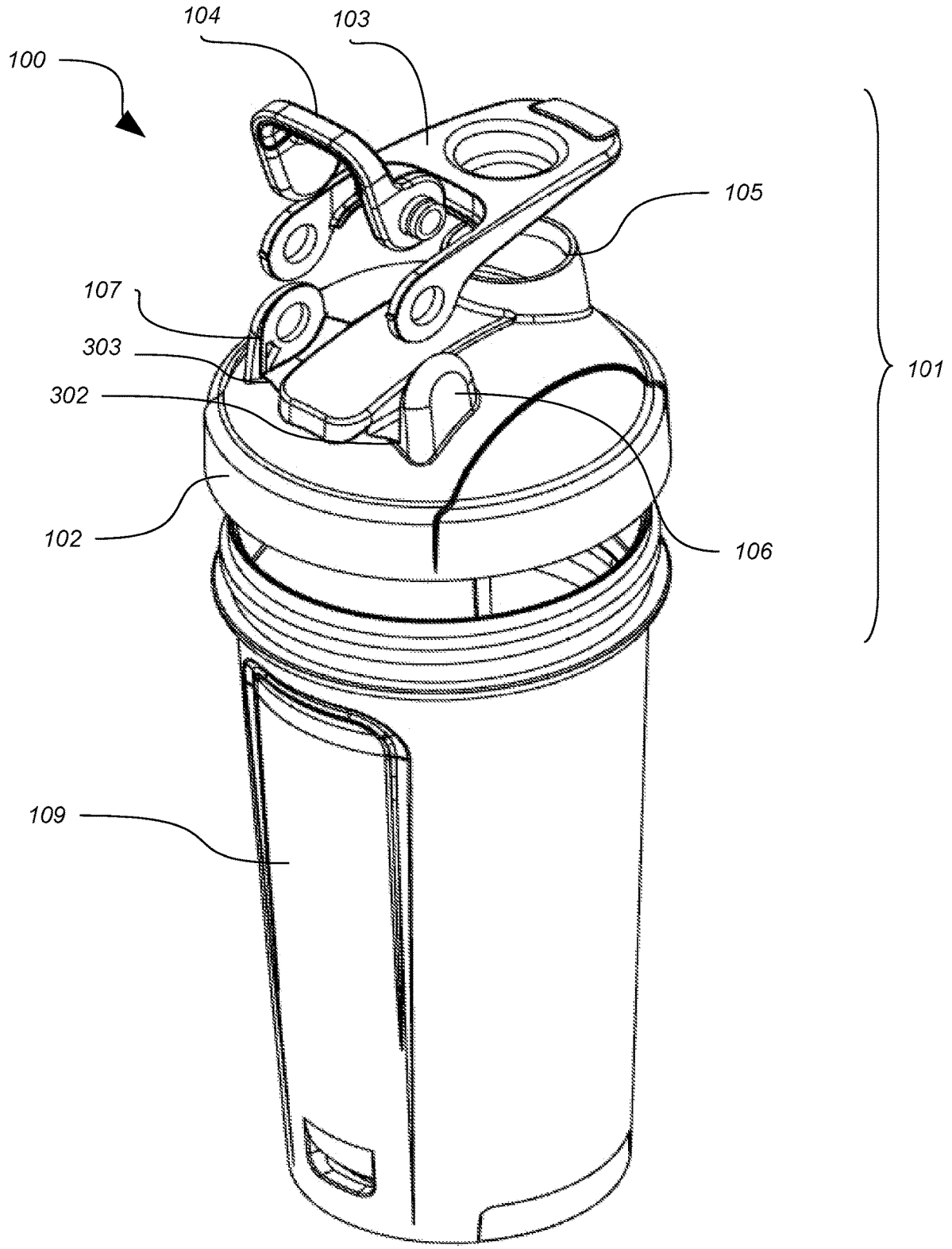
FIG. 4 is a fourth perspective, fully exploded view of one embodiment of a container lid in a shaker bottle environment.

Lid body 102 may have a integrally formed and generally bounded slots on and/or adjacent a top surface. Referring specifically to FIG. 3, a first slot 302 is positioned inside a first ear 106 and a second slot 303 is positioned inside a second ear 107. Slots are shaped and configured to retain portions of the cap body and carry loop adjacent to pivotal engagements of these elements. This structure improves the stability of the flip cap and pivot connections over other structures in the prior art. Notably, the structure of the lid body combined with the cap body-carry loop connections (discussed below) also optimizes stability of the pivotable elements by incorporating relatively thin (compared to prior art) rounded connections that eliminate the unevenness and sticking that can occur from larger plastic pieces (e.g., hollow cylinders with ribs) that are more susceptible to warping and shrinkage (in plastic embodiments).

Figure 6:
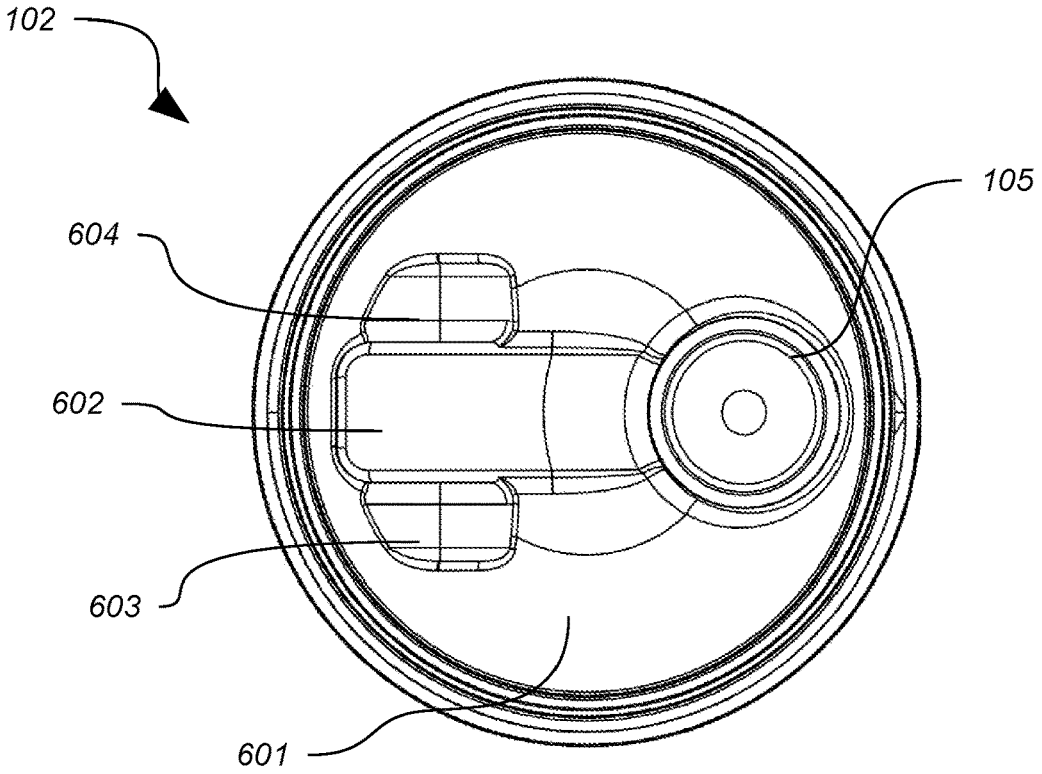
FIG. 6 is a bottom view of one embodiment of a container lid.
Figure 7:
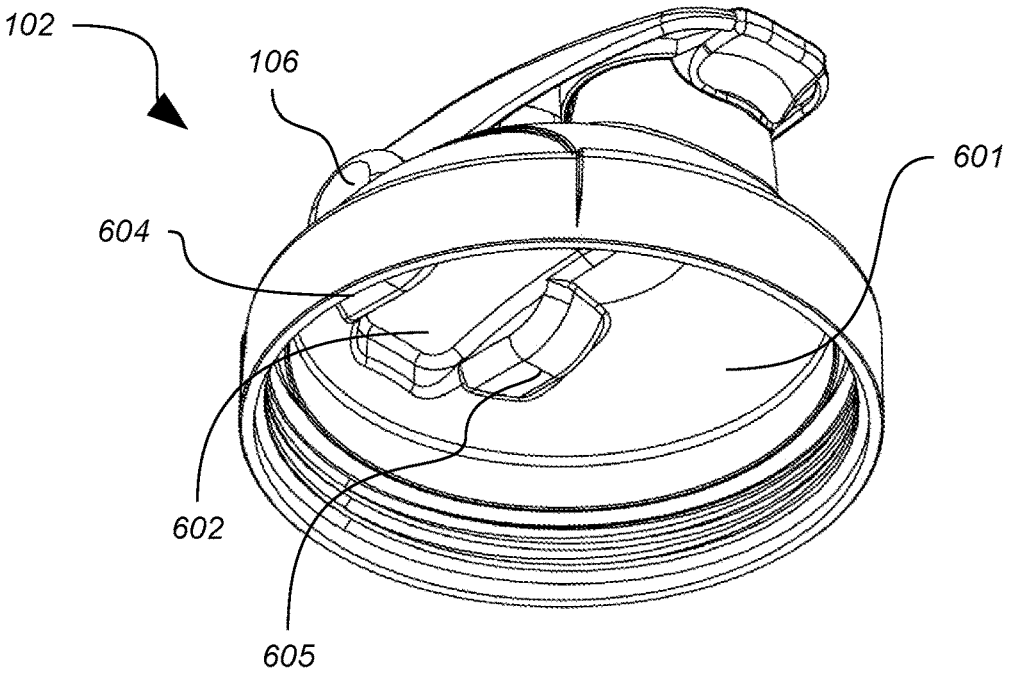
FIG. 7 is a fifth perspective view of one embodiment of a container lid.

Referring briefly to FIGS. 6 and 7, the underside and/or bottom of the lid body 102 may incorporate certain features or structure to optimize the interior volume of a shaker bottle when in use. More particularly, by optimizing the interior volume of the lid and/or shaker bottle through structure, more "negative" space may be achieved within the shaker bottle in relation to a specific volume of to-be-mixed contents, especially compared to other prior art lid designs. This greatly improves fluid and mixing dynamics. In the illustrated embodiment, the underside and/or bottom 601 of the lid body 102 has one or more of a space and recess 602 between first 603 and second 604 otherwise inward protrusions that may correspond to the slots 302, 303 on the top of the lid body 102.

Figure 5:
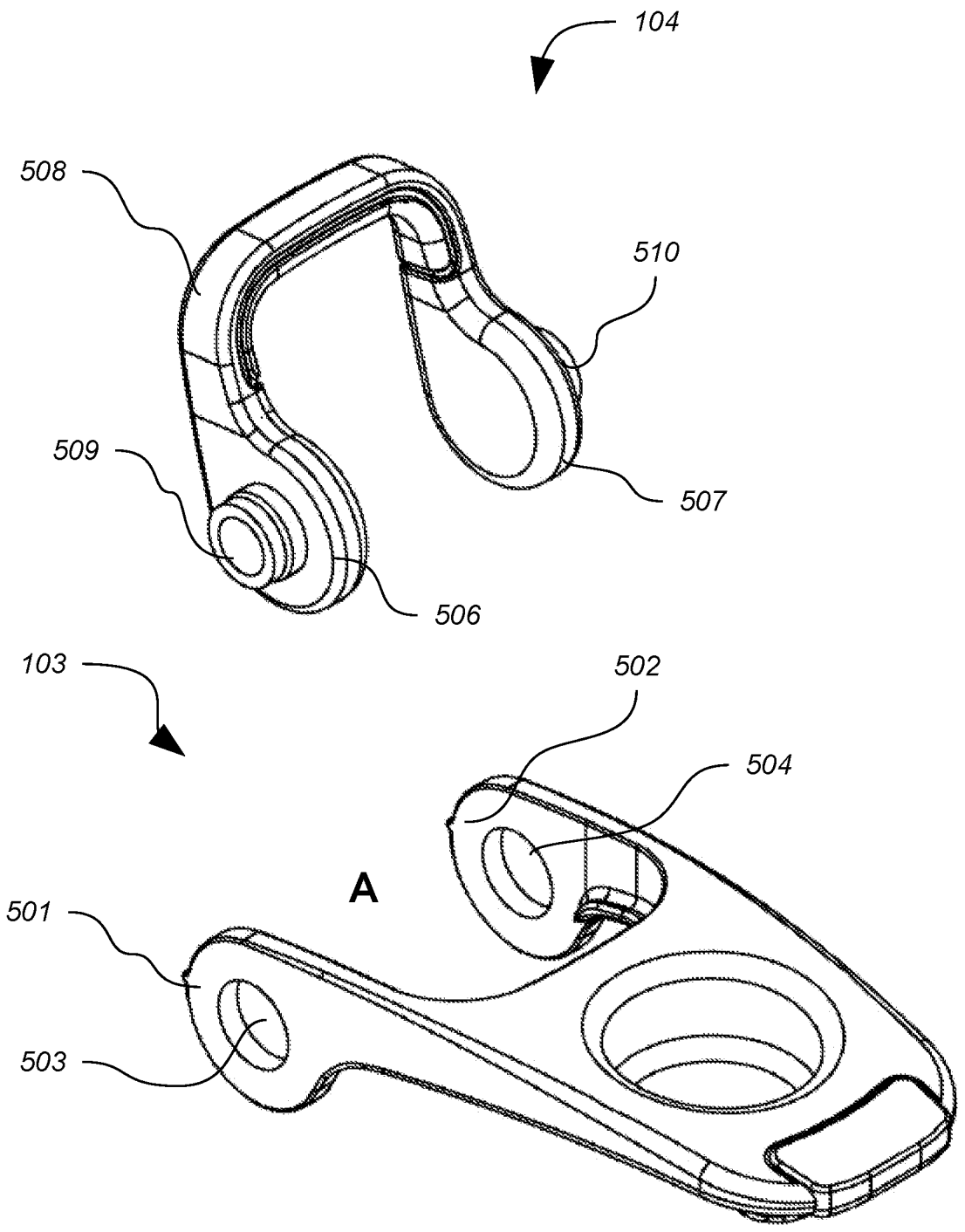
FIG. 5 is a perspective view of a cap body and carry loop with connector in one embodiment of a container lid.

Referring back to FIGS. 1 through 4, as noted above, cap body 103 has a closure 108 for the drinking spout 105, which may seal the spout 105 with a snap, interference, or similar type mechanism. Referring additionally to FIG. 5, cap body 103 has a first end opposite a second end. Adjacent to the first end, cap body 103 has first 501 and second 502 shoulder portions. Adjacent first 501 and second 502 shoulder portions are fastener portions 503, 504 that are configured to facilitate attachment of the cap body 103 to the lid body 102 (at cars 106, 107 or otherwise) to form a first pivotable engagement of the cap body 103 with respect to the lid body 102. Here, fastener portions are shown as apertures, but other embodiments may employ connectors, pegs, or still other structures. Cap body 103 also has one or more of an aperture, recess, and/or space A adjacent its first end, which may have functional purposes described in more detail below. In the illustrated embodiment, the attachment of the cap body 103 to the lid body 102 is further facilitated by the structure of the ring with a connector (or carry loop) 104.

Referring now to FIGS. 1 through 5, ring with a connector 104 (or carry loop) is configured to attach the carry loop 104 to the cap body 103 and/or the lid body 102 and to form a second pivotable engagement. The carry loop 104 is further configured to nest within the cap body 103 in one or more positions for which examples are given below. The carry loop and/or ring with connector 104 may have first 506 and second 507 shoulder portions, with adjacent fastener portions 509, 510 configured to attach the carry loop 104 to the cap body 103 and/or to the lid body 102 (at cars 106, 107 or otherwise). The carry loop 104 may also have a bridge or one or more side portions 508 between shoulder and/or fastener portions. The ring with a connector 104 may be open, partially open, closed, or partially closed and be of many different shapes and configurations without departing from the purpose or scope of the invention.

Cap body 103 and carry loop 104 may be releasably attachable to each other and/or the lid body 102 through their respective fastener portions. When the cap body 103 and carry loop 104 are attached, the carry loop 104 is generally positioned inside of the cap body 103 in that the first 501 and second shoulders 502 of the cap body 103 generally bookend the fastener portion and/or connector of the carry loop 104.

Figure 8:
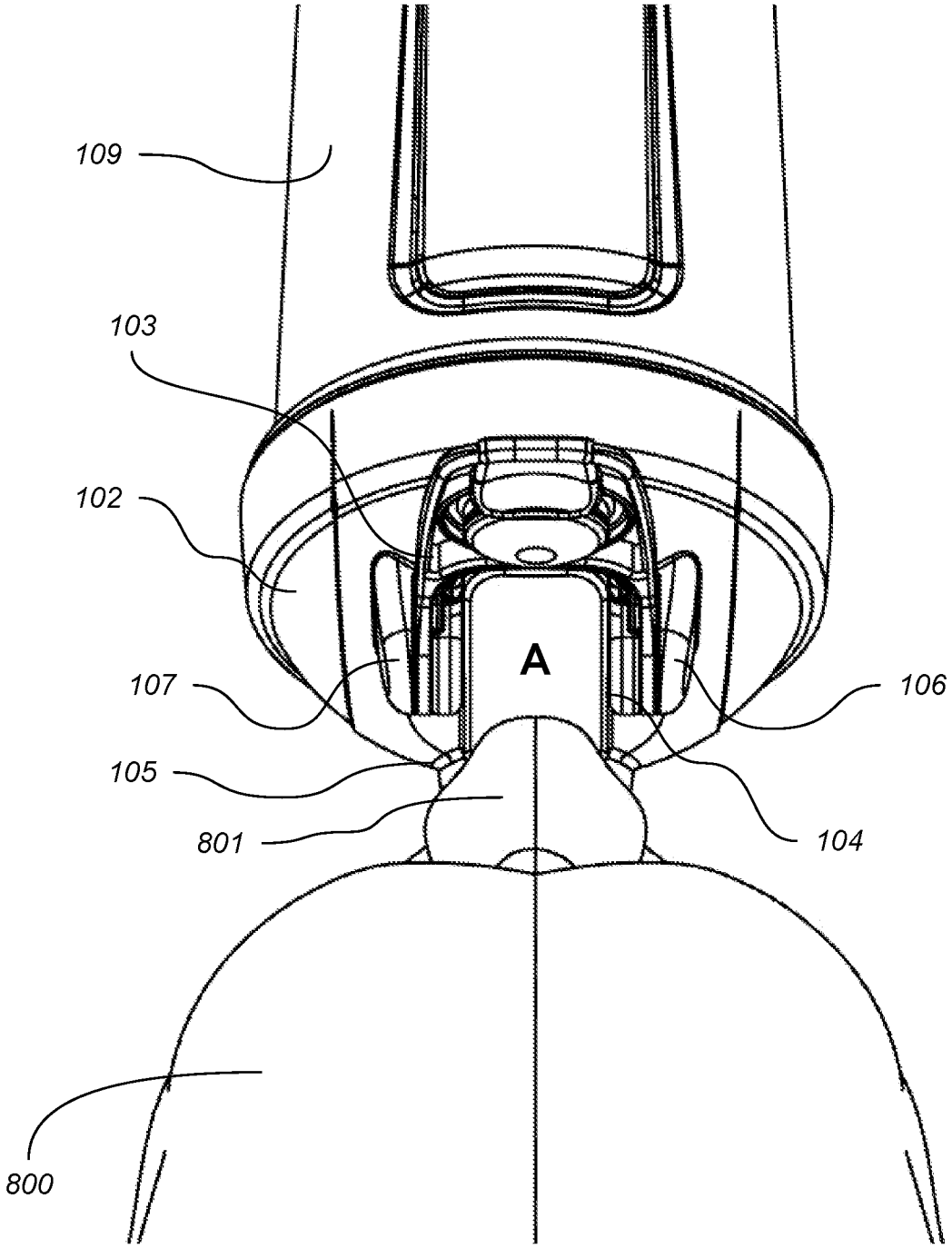
FIG. 8 is a sixth perspective view of one embodiment of a container lid in a shaker bottle and drinking user environment.

Referring now to FIG. 8, in use, cap body 103 (particularly cap body first end space or recess A), and/or the cap body 103 with the ring with a connector 104, are configured to accommodate a user's nose 801 through, for example, space A, when the cap body 103 is in an open position. While many shaker bottles have a cap body-lid body connection that either raises the elevation of the lid or provides some other obstruction that restricts the angle at which a user 800 can tilt a shaker bottle to drink, the illustrated embodiment incorporates space A for a user's nose 801 while the user is drinking from the spout 105, thus increasing the angle at which a user 800 can tilt the shaker bottle 109 to drink.

Figure 9:
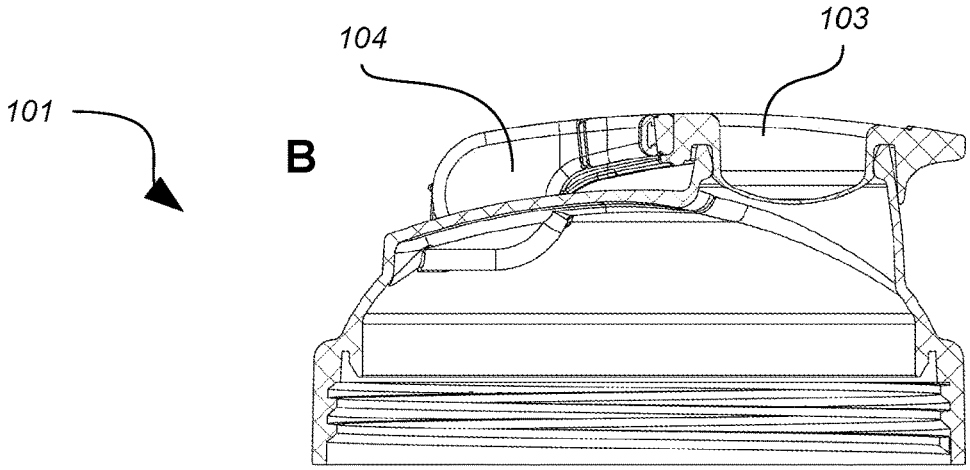
FIG. 9 is a first cross-section view of one embodiment of a container lid in a first position.
Figure 10:
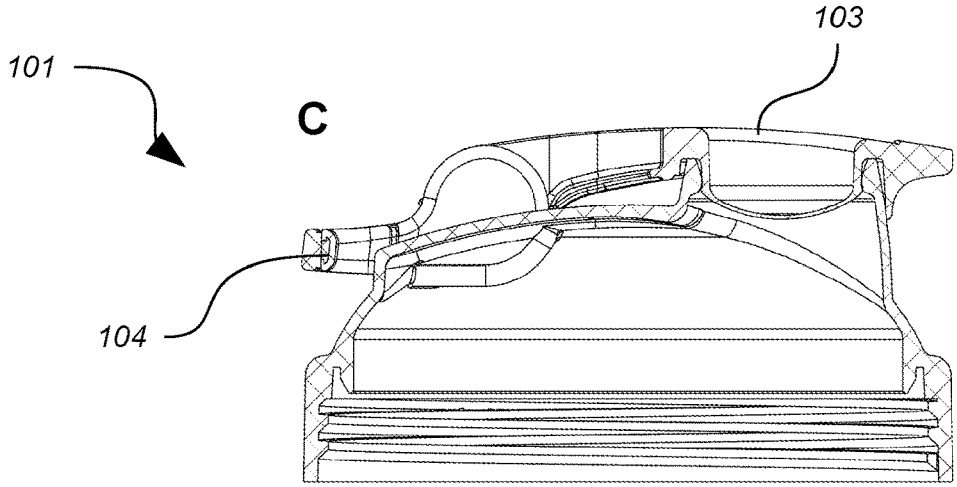
FIG. 10 is a second cross-section view of one embodiment of a container lid in a second position.
Figure 11:
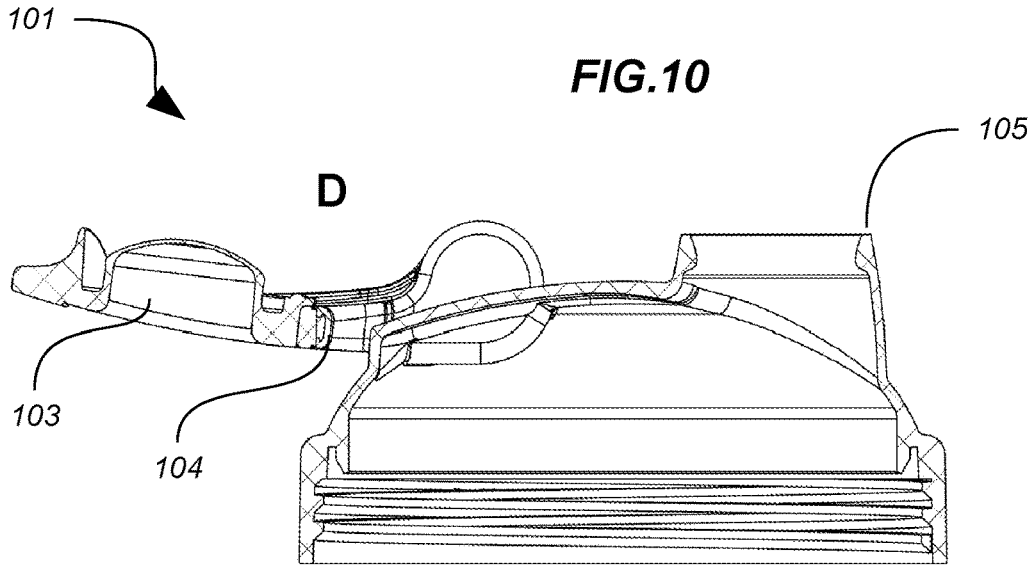
FIG. 11 is a third cross-section view of one embodiment of a container lid in a third position.

Referring now to FIGS. 9 through 11, the first and second pivotable engagements and exemplary positions of the cap body and ring with connector are explained in more detail. Cap body 103 and carry loop 104 may pivot independently of each other and/or the cap body 103 may be configured to carry the carry loop 104 when the cap body 103 is pivoted by a user. Within pivotable engagements, the carry loop and/or the cap body 103 have an approximately 180-degree pivot range when attached to the lid body 102. Accordingly, the lid 101 may have a first position B wherein the cap body closure closes the spout and the carry loop is nested within the cap body, in for example, a generally horizontal position. The lid 101 may have a second position C wherein the carry loop is pivoted away from the cap body, such as, for example, to a second generally horizontal position away from the spout. Further, the lid may have a third position wherein the cap and body, together with the ring with connector are pivoted away from the spout, thereby providing for an open drinking position for a user. Of course, intermediate positions may exist between any and/or all of those illustrated above.

So configured, the lid provides optimized mixing capability through a unique pivotable flip cap and nesting carry loop structure. To summarize some of the functional and structural benefits discussed above: First, the structure of the lid body, cap body, and carry loop—and particularly the connections thereof—provide increased stability and consistency with a design that is minimalist and elegant in relation to the abovementioned problems that it addresses and solves. Second, the recessed structure of the underside of the lid optimizes interior volume of the lid by providing more "negative" space to improve fluid and mixing dynamics. Third, space in the cap body and/or carry loop accommodates a user's nose while the user is drinking from the spout, thus increasing the angle at which a user can tilt the shaker bottle to drink. Fourth, the pivotable flip cap and nesting carry loop allows the cap body to pivot 180 degrees away from the spout, instead of at lesser angles found in prior art cap body and carry loop combinations. While the flap cap and carry loop of the prior art, with its restricted angles, has a tendency for the flip cap to hit a user's face when the user is drinking, the embodiments herein, with their less restricted angles and 180-degree range, avoid this tendency of the flip cap to hit the user's face when the user is drinking.

More functional and structural benefits, beyond those discussed above, are apparent. For example, fifth, because of the added range of travel of the cap body and carry loop, additional features can be added to the top of the cap body and/or lid, such as, for example, one or more clips configured to retain one or more of a credit card, debit card, driver's license, membership card, loyalty card, and the like. Other features may include straps or bands that extend across and/or over the flip cap. Sixth, the configuration of the cap body and carry loop facilitate even stacking of the lid body because, unlike other designs in the prior art, the carry loop does not stick backward beyond the lid body sidewall or upward above the lid body cars. Seventh, the unique cap body and carry loop structure with space A reduces the amount of plastic material needed compared to shaker bottles with analogous features, thereby providing added cost-of-manufacturing reduction and important environmental benefits.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

I claim:

1. A lid comprising:

a lid body with a drinking spout, the lid body having two or more integrally formed and generally bounded slots;

a cap body with a closure for the drinking spout, the cap body having a first end opposite a second end, first and second shoulders adjacent the first end, and fastener portions adjacent the shoulders and configured to facilitate attachment of the cap body to the lid body and form a first pivotable engagement; and a carry loop with a connector for attaching the carry loop to the cap body and configured to form a second pivotable engagement, the carry loop with a connector further configured to nest within the cap body;

wherein the two or more integrally formed and generally bounded slots on the lid body are configured to retain portions of the cap body and carry loop adjacent to first and second pivotable engagements.

2. The lid of claim 1, wherein the lid body with a drinking spout has a top side of the lid opposite a bottom side of the lid, the bottom side of the lid having two protrusions with one or more of a space and recess between the protrusions.

3. The lid of claim 1, wherein the cap body has a recess at the first end for accommodating a user's nose when the cap body is in an open position.

4. The lid of claim 1, wherein the carry loop with a connector has an approximately 180-degree range of pivot when it is attached to the cap body and lid.

5. The lid of claim 1, wherein the carry loop with a connector has a first generally horizontal position where it is nested within the cap body facing the spout and a second generally horizontal position where it faces away from the spout.

6. A lid comprising:

a lid body with a drinking spout and a top side opposite a bottom side, the bottom side having two protrusions with one or more of a space and recess between the protrusions;

a cap body with a closure for the drinking spout, the cap body having a first end opposite a second end, first and second shoulders adjacent the first end, fastener portions adjacent the shoulders and configured to facilitate attachment of the cap body to the lid body and form a first pivotable engagement, and a recess at the first end for accommodating a user's nose when the cap body is in an open position; and a carry loop with a connector for attaching the carry loop to the cap body and configured to form a second pivotable engagement, the carry loop with a connector further configured to nest within the cap body;

wherein the first and second shoulders of the cap body generally bookend the connector.

7. The lid of claim 6, wherein the cap body is configured to carry the carry loop with connector when the cap body is being pivoted by a user.

8. The lid of claim 6, wherein the carry loop with a connector has an approximately 180-degree range of pivot when it is attached to the cap body and lid.

9. The lid of claim 6, wherein the ring with a connector has a first generally horizontal position where it is nested within the cap body toward spout and a second generally horizontal position away from the spout.

10. The lid of claim 6, further comprising one or more clips configured to retain one or more of a bank card, credit card, debit card, driver's license, membership card, loyalty card, permit card, access card, and rewards card.

11. A lid comprising:

a lid body with a drinking spout and a top side opposite a bottom side, the bottom side having two protrusions with one or more of a space and recess between the protrusions;

a cap body with a closure for the drinking spout, the cap body having a first end opposite a second end, first and second shoulders adjacent the first end, fastener portions adjacent the shoulders and configured to facilitate attachment of the cap body to the lid body and form a first pivotable engagement, and a recess at the first end for accommodating a user's nose when the cap body is in an open position; and a carry loop with a connector for attaching the ring to the cap body and configured to form a second pivotable engagement, the carry loop with a connector further configured to nest within the cap body, the carry loop with a connector further having a first generally horizontal position where it is nested within the cap body towards the spout and a second generally horizontal position away from the spout;

wherein the first and second shoulders of the cap body generally bookend the connector.

12. The lid of claim 11, further comprising the lid body having two or more integrally formed and generally bounded slots configured to retain portions of the cap body and carry loop adjacent to first and second pivotable engagements.

* * * * *